US006520335B2

(12) United States Patent
Moran et al.

(10) Patent No.: US 6,520,335 B2
(45) Date of Patent: Feb. 18, 2003

(54) METHOD AND CONTAINER FOR PACKAGING MULTI-COMPONENT POLYMER COATINGS AND ADHESIVES

(76) Inventors: Daniel E. Moran, 829 Greenacres La., Glenview, IL (US) 60025; Mark G. Moran, 3520 N. Lake Shore Dr., Chicago, IL (US) 60657

( * ) Notice: Subject to any disclaimer, the term of this patent is extended or adjusted under 35 U.S.C. 154(b) by 0 days.

(21) Appl. No.: 09/789,221

(22) Filed: Feb. 20, 2001

(65) Prior Publication Data

US 2002/0112984 A1 Aug. 22, 2002

(51) Int. Cl.[7] ..... R65D 71/00
(52) U.S. Cl. ..... 206/568; 206/219
(58) Field of Search ..... 206/223, 568, 206/569, 219; 53/474; 215/DIG. 8; 383/38–40

(56) References Cited

U.S. PATENT DOCUMENTS 1,332,985 A * 3/1920 Jarrett ..... 206/219
3,266,625 A * 8/1966 Hardman ..... 206/568
4,291,799 A * 9/1981 Bower, Jr. ..... 206/219
4,985,232 A * 1/1991 Jacobssen ..... 206/569
5,287,961 A * 2/1994 Herran ..... 206/219
5,333,737 A * 8/1994 Clark ..... 206/219
5,492,219 A * 2/1996 Stupar ..... 206/219

* cited by examiner

*Primary Examiner*—Luan K. Bui
(74) *Attorney, Agent, or Firm*—Baniak Pine & Gannon

(57) ABSTRACT

A method, container and kit for a two-component polymeric material, such as an epoxy coating includes filling a first pouch with a polymeric precursor material. A second pouch is filled with a curing agent. The first and second pouches are sealed. The first and second pouches are inserted into a mixing container and the mixing container is sealed. The first pouch can be filled with a first amount of polymeric precursor material. The second pouch can be filled with a second amount of curing agent with the first and second amounts totaling a first volume. The mixing container can have a second volume, with the first volume being greater than about half the second volume. The contents of the pouches can be transferred to the mixing container and mixed therein to react the components and dispense the resulting material.

10 Claims, 1 Drawing Sheet

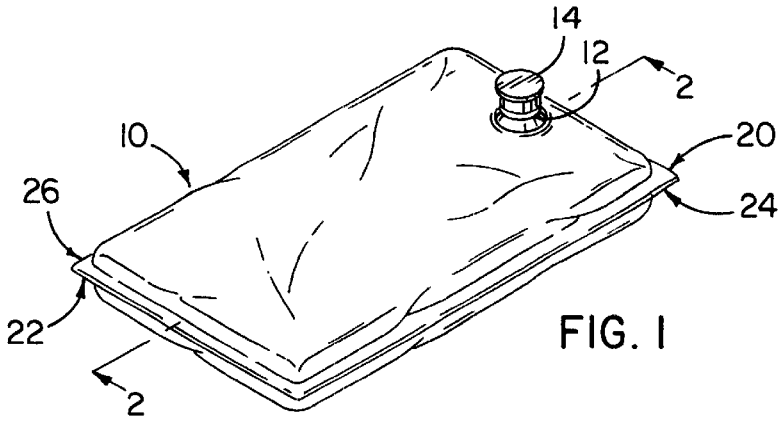
FIG. 1
FIG. 2
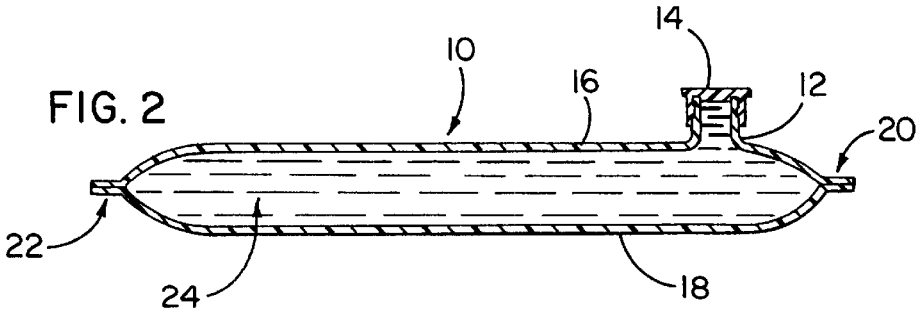
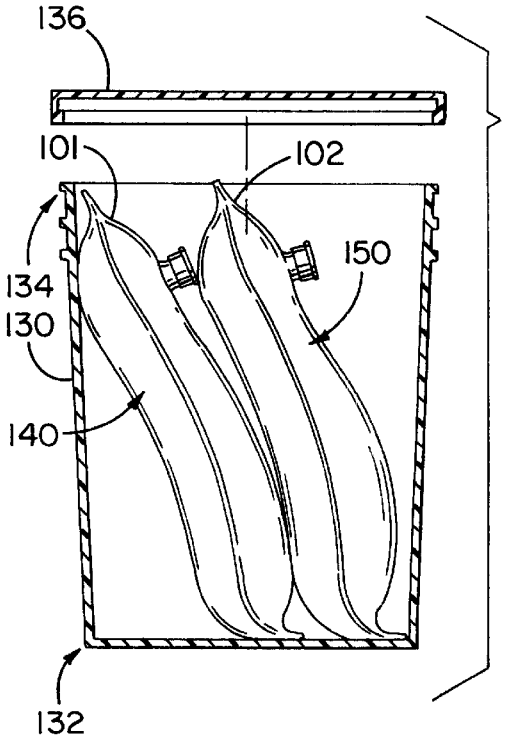
FIG. 3
FIG. 4
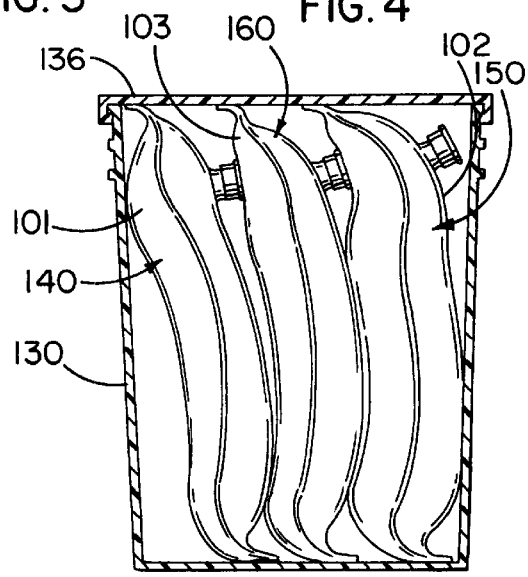

METHOD AND CONTAINER FOR PACKAGING MULTI-COMPONENT POLYMER COATINGS AND ADHESIVES

TECHNICAL FIELD

The present invention relates generally to containers and, in particular, to containers containing unmixed two-part liquid compounds. The invention includes a method and kit for packaging such compounds.

BACKGROUND OF THE INVENTION

A variety of chemical compounds, such as two component epoxy coatings, urethane paints, polymeric coatings, multi-part resinous materials, e.g., coatings and adhesives, and the like, include two parts, which comprise a base material, such as a polymer or monomer resin, to which an accelerator or catalyst is added just prior to use. The two components must be stored separately and mixed together shortly before use. Some of these compounds require the admixture of multiple components just prior to use. These compounds may comprise an epoxy or urethane base to which a curing agent, catalyst, accelerator or hardener is added in a predetermined proportion just prior to use of the material. Additional components may include colorants, texturizers, fillers and so on. After mixing, the composition can then be used for its intended purpose.

A variety of containers for holding multiple components separate from one another have been suggested. One example (U.S. Pat. No. 5,083,674) includes a two-compartment container for epoxy adhesives including an upper and lower pail shaped container, each including a removable cover. The lower end of the upper container is bonded to the cover of the lower container so that both containers form a unitary structure when the cover is in place on the lower container. One of the two pails might be used to combine the two components. In this case, proper disposal of both pails and the cradle would be required after combining the two components, thus creating a significant negative environmental impact.

Another example, generally known as "bag-in-bag", (as exemplified in U.S. Pat. No. 5,353,927) includes a package for housing and mixing two materials; such as an epoxy resin and a polyamine adduct, together to form an adhesive. Two sheets are joined together to form the outer periphery of the bag. A third sheet is secured between the outer sheets and divides the package into two compartments. When the one compartment is ruptured, the adduct contained therein is released into the other compartment and mixing may take place. After the two materials are completely mixed the adhesive is ready for use. However, with regard to large batch sizes, for example, in an industrial installation, it may be cumbersome to mix the components in a flexible bag. Therefore the use of such packaging systems may be impractical in large-scale use.

More commonly, such compounds are sold to consumers in separate containers that, except for their markings, are physically identical to each other. One example of such packaging includes a pair of metal pails, each contained in a separate box. In such a liquid packaging arrangement, each pail is provided with an appropriate amount of a desired component and then packaged in a similar cardboard box. The use of two separate containers creates the possibility that one of the containers might become misplaced or lost, creating a significant waste of the other of the two components. If dropped, the contents of an inner pail may be spilled.

Use of similar containers may increase of contamination of one component with another in the event that a lid from one component is used to cap a container of the other component. This would increase material waste and if not discovered, might increase the likelihood of non-homogenous mixing of components or spoiled batches. Also, use of multiple pail packaging systems (i.e., use of two or more pails) produces a significant amount of packaging waste in addition to the disposal of the mixing vessel after use and emptying thereof. Therefore, the negative environmental impact of such packaging systems can be significant.

As mentioned, the importance of proper mixing is significant in multi-component products. With respect to epoxies, and the like, where proper mixing is required for the compounds to be properly completely reacted, it is especially important to provide an appropriate mixing vessel adapted to receive the components and permit thorough mixing therein.

It would be desirable to provide a package intended to overcome or minimize all of these problems, as well as to present several other advantages.

SUMMARY OF THE INVENTION

One aspect of the present invention provides a method of packaging an epoxy coating including filling a first pouch with a polymeric precursor material. A second pouch is filled with a curing agent. The first and second pouches are sealed. The first and second pouches are inserted into a mixing container and the mixing container is sealed. The first pouch can be filled with a first amount of polymeric precursor material. The second pouch can be filled with a second amount of curing agent with the first and second amounts totaling a first volume. The mixing container can have a second volume, with the first volume being greater than about half the second volume.

Other aspects of the present invention include the first volume being from about 50 percent to about 80 percent of the second volume. The first volume can be from about 60 percent to about 75 percent of the second volume. A third pouch can be filled with a colorant and the third pouch can be inserted into the mixing container along the first and second pouches. The third pouch can be filled with a third amount of colorant, the first, second and third amounts totaling a first volume, with the first volume being greater than about half the second volume. The first volume can be from about 50 percent to about 80 percent of the second volume. The first volume can be from about 60 percent to about 75 percent of the second volume.

Another aspect of the present invention includes an epoxy coating preparation kit including a polymeric precursor material filled pouch, a curing agent filled pouch and a mixing container adapted to receive the pouches and allow preparation of the epoxy coating therein. The pouches can be three-ply pouches. The pouches can include inner and outer layers of polyethylene. The pouches can include a middle layer of biaxially oriented nylon. The pouches can be laminated from at least one barrier film material. Each of the pouches can include a removable cap. The mixing container can be a plastic pail. The plastic pail can be made of high-density polyethylene. The mixing container can be a metal pail. The resin filled pouch can contain a first amount of polymeric precursor material, the curing agent filled pouch can contain a second amount of curing agent, the first and second amounts totaling a first volume, the mixing container having a second volume, the first volume being greater than about half the second volume. The first volume can be from about 50 percent to about 80 percent of the second volume. The first volume can be from about 60 percent to about 75 percent of the second volume.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 1 is a perspective view of one embodiment of a package according to the present invention;

FIG. 2 is a cross sectional view of the package along line 2—2 of FIG. 1;

FIG. 3 is a partial cross sectional side view of one embodiment of a pair of packages positioned within an unsealed mixing container according to the present invention; and FIG. 4 is a partial cross sectional side view of one embodiment of a sealed mixing container with three packages positioned therein according to the present invention.

DESCRIPTION OF THE PRESENTLY PREFERRED EMBODIMENTS

Referring to FIG. 1, one embodiment of the present invention is shown. As illustrated, the present invention includes a flexible package or pouch 10 that is used for holding one part of a two-component (or more than two-component) material. The two components can include a curing agent and a polymeric precursor material. For example, the curing agent can be a polyamine adduct, and the polymeric precursor material can be an epoxy resin. Of course, other types of two-component materials can be similarly packaged. The package 10 is intended to be used once and then discarded.

The package 10 can include a stem 12. The stem can be integral with the package 10 or otherwise attached to the package. The stem 12 can have a generally hollow cylindrical shape for package filling, dispensing, and the like. Attached to the stem is a cap 14. The cap 14 can be a conventional cap. In a preferred embodiment, the cap 14 is designed for easy attachment to and sealing of the stem 12 but made difficult to remove. This is so that the enclosed material cannot be released from the package 10 via the stem 12 accidentally.

As clearly shown in FIG. 2, the package 10 is generally comprised of a pair of sheets 16, 18 suitably joined at their edges 20, 22 to form a compartment 24. The sheets 16, 18 can be an equal size and can take one of many forms. In a preferred embodiment, the sheets 16, 18 are rectangular. To join the sheets 16, 18, an edge area (20, 22, 24, 26—FIG. 1) around each of the sheets 16, 18 is bonded together. The edges 20, 22, 24, 26 may be joined by heat-sealing, application of adhesives or any known joining and sealing method.

The sheets 16, 18 can be laminated or co-extruded films or single layer plastic sheets. In one preferred embodiment, the sheets 16, 18 are 3-ply plastic films that include barrier properties specific to the material intended to be contained therein. Since the two-component materials are designed to be reactive to form a resultant coating or adhesive, or the like, it is important that the chemical materials must not be allowed to migrate from respective packages or otherwise be permitted to react with each other. For example, in the embodiment including a curing agent and a polymeric precursor material, the structure of each sheet 16, 18 can include an inner and an outer layer of polyethylene and a middle layer of biaxially oriented nylon (not shown). In this manner, the package or pouch 10 can possess both chemical barrier properties and a substantial strength to avoid unwanted reactions between the components and rupture during filling, shipping and use thereof. Other films, as is known in the art, are suitable for use in meeting the strength and barrier requirements of the package 10.

The package 10 can include a cylindrical stem, spout or port 12 as previously described, which can be used for filling purposes. A cap 14 can be provided the stem 12 for sealing the package 10 after filling. In one embodiment, the cap 14 is a snap fit to the stem 12 to reduce the possibility of the cap 14 being detached after filling of the package 10. In this manner, the cap 14 may be designed to be fitted to the stem 12 easily, but made difficult to remove. This arrangement reduces the possibility of the cap 14 loosening and leaking after filling of the package 10 is completed. In the alternate, the cap 14 may be sealed to the stem 12 by way of a screw-type arrangement or other suitable arrangement.

In an alternate embodiment (not shown), the package 10 can lack a stem and cap arrangement. In this embodiment, the sheets can be sealed on all sides except one fill side. The package can be filled through the unsealed side and then closed by sealing the fill side.

Referring to FIG. 3, an embodiment of the present invention including a pair of packages 101, 102 disposed in a mixing container or receptacle 130, is shown. The receptacle 130 can have a substantially circular cross section with a closed lower end 132 and an open upper end 134. In the embodiment shown, the diameter of the upper end 134 is greater than the diameter of the lower end 132. A substantially disk-shaped cover member or lid 136 is provided, which can be sealed to and detached from the upper end 134 of the receptacle 130. The lid 136 can be provided, it is known in the art, with a tamper evident tear strip (not shown) for securing the lid to the container 130. The container 130 and cover member 136 can be formed of plastic, high-density polyethylene (HDPE), metal or any other suitable material.

FIG. 3 also illustrates a first and second package or pouch 101, 102 positioned within the receptacle 130. The first package 101 can contain the first component 140 and the second package 102 can contain the second component 150. It will be understood that the components 140, 150 will be provided in amounts appropriate for stoichiometric reaction. In the illustration provided, the amounts or ratio of component A 140 to component B 150 is shown as about 1:1. Without being limited thereby, two-part thermosetting materials, such as epoxy, can be provided in a range of ratios from 1:1 to 10:1 (or greater), resin to curing agent. Other coatings and materials can be provided in appropriate ratios reflecting the components used. Accordingly, the relative size of the pouches 101, 102 and the component provided therein can be adjusted to the particular components used.

The size of the container 130 can be any suitable size. In one example, the size of the container 130 is 4 ¼ gallons. In this case, the amounts of material provided would be intended for a large-scale project, for example, providing a floor with an epoxy-based coating. Smaller and larger capacity containers can be used according to the application intended whether it be a small repair to a concrete floor or an entire installation of a commercial warehouse floor.

The container 130 is provided to be both a shipping container and serve as a mixing container. In this respect, the total volume of the components 140, 150 can be from about 40 to about 90 percent of the volume of the container 130. In this manner, mixing can effectively take place after the components 140, 150 are transferred from the pouches 101, 102 into the container 130. More preferably, the total volume of the components 140, 150 is from about 50 to about 75 percent of the volume of the container 130. Since the viscosity of the combined components 140, 150 can vary from a low viscosity material with a water-like viscosity to a high viscosity material it will be understood that the total volume of the components 140, 150 can be adjusted to allow efficient and safe mixing in the container 130. Accordingly, a material with a low viscosity might be provided at a combined or total volume of about 60 percent, while a high viscosity material might be safely mixed at a total volume of about 70 percent of the container 130. In the example illustrated in FIG. 3, the two components 140, 150 represent a total volume of about 3 gallons in a 4 ¼ gallon container and fill the container 130 when transferred from the pouches 101, 102 and fill the container 130 about 70 percent. While two pouches 101, 102 are shown in substantially equal proportions, it will be understood that other proportions are contemplated.

Referring to FIG. 4, an embodiment of the present invention providing three components 140, 150, 160 in a mixing container 130 is illustrated. Again, it will be understood that while the amounts of the components 140, 150, 160 are depicted as being provided in approximately equal amounts, the actual amounts will depend upon the specific materials and formulations desired.

In this embodiment, a first pouch 101 can be provided containing a polymeric precursor material 140. A second pouch amended to can be provided with a curing agent 150. An optional third pouch 103 can be provided with a colorant 160 or other material, as is known in the art. Typically, colorants are used at relatively small percentages, in which case, the colorant can be provided in a small sized pouch. Examples of other material can include bulking agents such as texturizing agents, fillers, powdered materials, sand, and aggregate materials. In the event the three-component material is intended to be used in the preparation of a grout, for example, the third material can include a bulking agent. The container 130 can be like that illustrated in FIG. 3. However, FIG. 4 shows the cover member 136 fixed into place on the upper end of the container 130.

In accordance with another aspect of the invention and referring again to FIG. 2, the receptacle 130 containing two or more components 140, 150 in separate pouches 101, 102 can be opened by removal of the cover member 136 in a standard manner. The contents of the pouches 101, 102 are transferred to the container 130. This can occur by an operator opening the pouches 101, 102, for example, by clipping off or removing a corner portion of the pouch. The contents 140, 150 are allowed to drain into the container. In this manner, the caps do not need to be removed from the pouches 101, 102 and only the two (or more) pouches 101, 102 are disposed. As previously mentioned, mixing can take place in the container 130. Any suitable method can be used to mix the components 140, 150, such as use of a mixing stick, paddle or other manual agitator. However, in the event that a large batch size is created, an agitator mounted to an electric drill can be used to reduce mixing effort and enhance the mixing action. The agitator can be a standard spiral blade turned by a low speed electric drill. The combined components are then used in the desired application. The waste thus created is limited to the pouches and a single mixing container per batch.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A preparation kit for preparing a multi-component polymeric material comprising:

a polymeric precursor material filled pouch;

a curing agent filled pouch; and a mixing container adapted to receive pouches and allow preparation of the multi-component material therein, and wherein the polymeric precursor material filled pouch contains a first amount of polymeric precursor material, the curing agent filled pouch contains a second amount of curing agent, the first and second amounts totaling a first volume, the mixing container having a second volume, the first volume being greater that about half the second volume.

2. The kit of claim 1 wherein the multi-component polymeric material includes an epoxy.

3. The kit of claim 1 wherein the pouches are three-ply pouches.

4. The kit of claim 3 wherein the pouches include inner and outer layers of polyethylene.

5. The kit of claim 4 wherein the pouches include a middle layer of biaxially oriented nylon.

6. The kit of claim 1 wherein the pouches are laminated from at least one barrier film material.

7. The kit of claim 1 wherein each of the pouches include a cap.

8. The kit of claim 1 wherein the mixing container is a plastic pail made of high-density polyethylene.

9. The kit of claim 1 wherein the first volume is from about 50 percent to about 80 percent of the second volume.

10. The kit of claim 1 wherein the first volume is from about 60 percent to about 75 percent of the second volume.

* * * * *